US009540020B2

(12) United States Patent
Sunde

(10) Patent No.: US 9,540,020 B2
(45) Date of Patent: Jan. 10, 2017

(54) BRAKING SYSTEM FOR A RAILWAY CAR

(71) Applicant: Amsted Rail-Faiveley, LLC, Greenville, SC (US)

(72) Inventor: Jonathan Sunde, Greenville, SC (US)

(73) Assignee: Amsted Rail-Faiveley, LLC, Greenville, SC (US)

( * ) Notice: Subject to any disclaimer, the term of this patent is extended or adjusted under 35 U.S.C. 154(b) by 0 days.

(21) Appl. No.: 14/270,411

(22) Filed: May 6, 2014

(65) Prior Publication Data

US 2015/0321681 A1 Nov. 12, 2015

(51) Int. Cl.

| | |
|---|---|
| ***B61H 13/00*** | (2006.01) |
| ***B61H 13/32*** | (2006.01) |
| ***B61H 1/00*** | (2006.01) |
| ***B61H 13/36*** | (2006.01) |
| ***B61H 15/00*** | (2006.01) |

(52) U.S. Cl.

CPC ..... *B61H 13/32* (2013.01); *B61H 1/00* (2013.01); *B61H 13/36* (2013.01); *B61H 15/0007* (2013.01)

(58) Field of Classification Search

CPC ..... B61H 13/20; B61H 13/38; B61H 15/0085; F16D 65/66

USPC ..... 188/52–54, 107, 153 R, 197

See application file for complete search history.

(56) References Cited

U.S. PATENT DOCUMENTS 190,019 A * 4/1877 Blunt ..... B62C 5/04 24/698.1
490,554 A * 1/1893 Gabler ..... B61H 13/24 188/53
660,647 A * 10/1900 Normand ..... 188/54
791,702 A * 6/1905 Raynolds ..... 188/54
823,942 A * 6/1906 Plichingger ..... B61H 13/24 188/53
1,092,917 A * 4/1914 Kiesel, Jr. ..... 188/46
1,267,555 A * 5/1918 Keemer ..... B61H 13/24 188/53
1,336,435 A * 4/1920 Ivey ..... B61H 13/24 188/53
1,745,502 A * 2/1930 Mihaly ..... B61H 13/24 188/53
1,875,380 A * 9/1932 Howard ..... B61H 13/24 105/182.1
2,102,222 A * 12/1937 Riley ..... B61H 13/24 188/53
2,120,323 A * 6/1938 Craig ..... B61H 13/24 188/46
2,282,374 A * 5/1942 Mueller ..... B61H 13/24 188/56
2,892,515 A * 6/1959 Osner ..... 188/52
3,378,108 A * 4/1968 McClure et al. ..... 188/52
(Continued)

*Primary Examiner* — Thomas J Williams
*Assistant Examiner* — Mahbubur Rashid
(74) *Attorney, Agent, or Firm* — Dority & Manning, P.A.

(57) ABSTRACT

The present invention includes a braking system for a railway car generally including a brake cylinder having a cylinder rod. The cylinder rod is in mechanical communication with a lever transfer assembly and is configured to articulate said lever transfer assembly. The lever transfer assembly may be rotatably connected to a first brake assembly and connected to a rear brake assembly through respective connection rods. Actuating the lever transfer assembly with the cylinder rod generates a divergent braking force between the first and second brake assemblies for slowing and/or stopping the railway car.

16 Claims, 7 Drawing Sheets

(56) References Cited

U.S. PATENT DOCUMENTS

| | | | | | |
|---|---|---|---|---|---|
| 3,731,766 | A * | 5/1973 | Campbell | 188/52 | |
| 4,613,016 | A | 9/1986 | Hart et al. | | |
| 4,830,148 | A | 5/1989 | Hart et al. | | |
| 5,069,312 | A * | 12/1991 | Kanjo et al. | 188/52 | |
| 5,259,485 | A * | 11/1993 | Jackson | 188/198 | |
| 5,507,368 | A | 4/1996 | Barefoot | | |
| 6,155,387 | A * | 12/2000 | Sauter | 188/226.1 | |
| 6,176,354 | B1 * | 1/2001 | Sauter | B61H 13/24 | 188/219.6 |
| 6,279,696 | B1 | 8/2001 | Daugherty, Jr. et al. | | |
| 6,332,515 | B1 * | 12/2001 | Sauter | B61H 13/24 | 188/153 R |
| 6,971,488 | B1 * | 12/2005 | Ring | B61H 13/24 | 188/107 |
| 7,216,940 | B2 | 5/2007 | Sommerfield | | |
| 7,472,775 | B2 * | 1/2009 | Tuten | 188/52 | |
| 7,802,662 | B2 | 9/2010 | Sommerfield | | |
| 2007/0023241 | A1 | 2/2007 | Ring | | |
| 2011/0108376 | A1 | 5/2011 | Call et al. | | |
| 2011/0147140 | A1 | 6/2011 | Ring | | |

* cited by examiner

BRAKING SYSTEM FOR A RAILWAY CAR

FIELD OF THE INVENTION

The present invention generally relates to a braking system for a railway car, or more particularly to a braking system for a railway car including a lever transfer system.

BACKGROUND OF THE INVENTION

Railway cars are widely used for transportation of goods and passengers throughout the United States and abroad. Railway cars generally include one or more truck assemblies including a plurality of specially designed wheels for traveling along a vast infrastructure of railway tracks. Braking systems are generally disposed between adjacent pairs of wheels for facilitating the stopping or slowing down of the railway car.

The braking systems generally include front and rear brake assemblies, each including a pair of brake heads with brake pads for contact with an outer periphery of the wheels when the front and rear brake assemblies are moved away from one another. Commonly, an air cylinder including a cylinder rod is provided in the braking system for generating a force for such movement. More particularly, the cylinder rod generally actuates a single lever rotatably connected to one of the front or rear brake assemblies. The lever in turn transfers a divergent braking force through a connection rod attached to the opposite brake assembly through another actuating lever. The divergent braking force moves the assemblies away from one another and presses the brake heads and pads against the wheels.

Due to certain characteristics of the railway cars, such as the weight, travel speeds, etc., the required amount of divergent braking force for slowing or stopping the railway cars may differ from car to car. However, the single lever design offers little adjustability in the amount of divergent braking force generated. Accordingly, in order to adjust an amount of divergent braking force in the known braking systems, the brake cylinder must be matched with the railway car under which the truck is mounted. When larger brake cylinders are required, difficulties and complications may arise during installation.

Additionally, the single lever design may generate rotational movement of the brake assemblies along with linear movement away from one another, resulting in brake pads from one side of the brake assemblies contacting the wheels before brake pads on the other side of the brake assemblies. This may cause certain brake pads to wear more quickly than others.

Therefore, a braking system that allows for more adjustment in the amount of divergent braking forces generated between the brake assemblies from the brake cylinder would be beneficial. Additionally, a braking system that more evenly and symmetrically moves the brake assemblies would be particularly useful.

BRIEF DESCRIPTION OF THE INVENTION

Aspects and advantages of the invention are set forth below in the following description, or may be obvious from the description, or may be learned through practice of the invention.

One embodiment of the present invention is a braking system for a railway car, the braking system defining a longitudinal centerline and including a first brake assembly and a second brake assembly spaced from one another along the longitudinal centerline. The braking system also includes a pair of live levers disposed opposite the longitudinal centerline from one another. The live levers are rotatably connected to the second brake assembly and connected to the first brake assembly through respective connection rods. Additionally, the braking system includes a brake cylinder in mechanical communication with a first end of each live lever for articulating each live lever and moving the first and second brake assemblies away from one another along the longitudinal centerline.

Another embodiment of the present invention is a braking system for a railway car, the braking system defining a longitudinal centerline and including a first brake assembly and a second brake assembly spaced from one another along the longitudinal centerline. The braking system also includes a first live lever and a second live lever, the first and second live levers connected to the first brake assembly using respective connection rods and rotatably connected to the second brake assembly at respective connection points. Additionally, the braking system includes a brake cylinder in mechanical communication with the first and second live levers for articulating the first and second live levers about their respective connection points and moving the first brake assembly away from the second brake assembly along the longitudinal centerline.

Still another embodiment of the present invention is a braking system for a railway car, the braking system defining a longitudinal centerline and including a first brake assembly and a second brake assembly spaced from one another along the longitudinal centerline. The braking system also includes a lever transfer assembly rotatably connected to the second brake assembly and connected to the first brake assembly through a pair of connection rods. The lever transfer assembly is substantially symmetric about the longitudinal centerline. Additionally, the braking assembly includes a brake cylinder in mechanical communication with the lever transfer assembly along the longitudinal centerline for actuating the lever transfer assembly and moving the first brake assembly away from the second brake assembly along the longitudinal centerline.

Those of skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
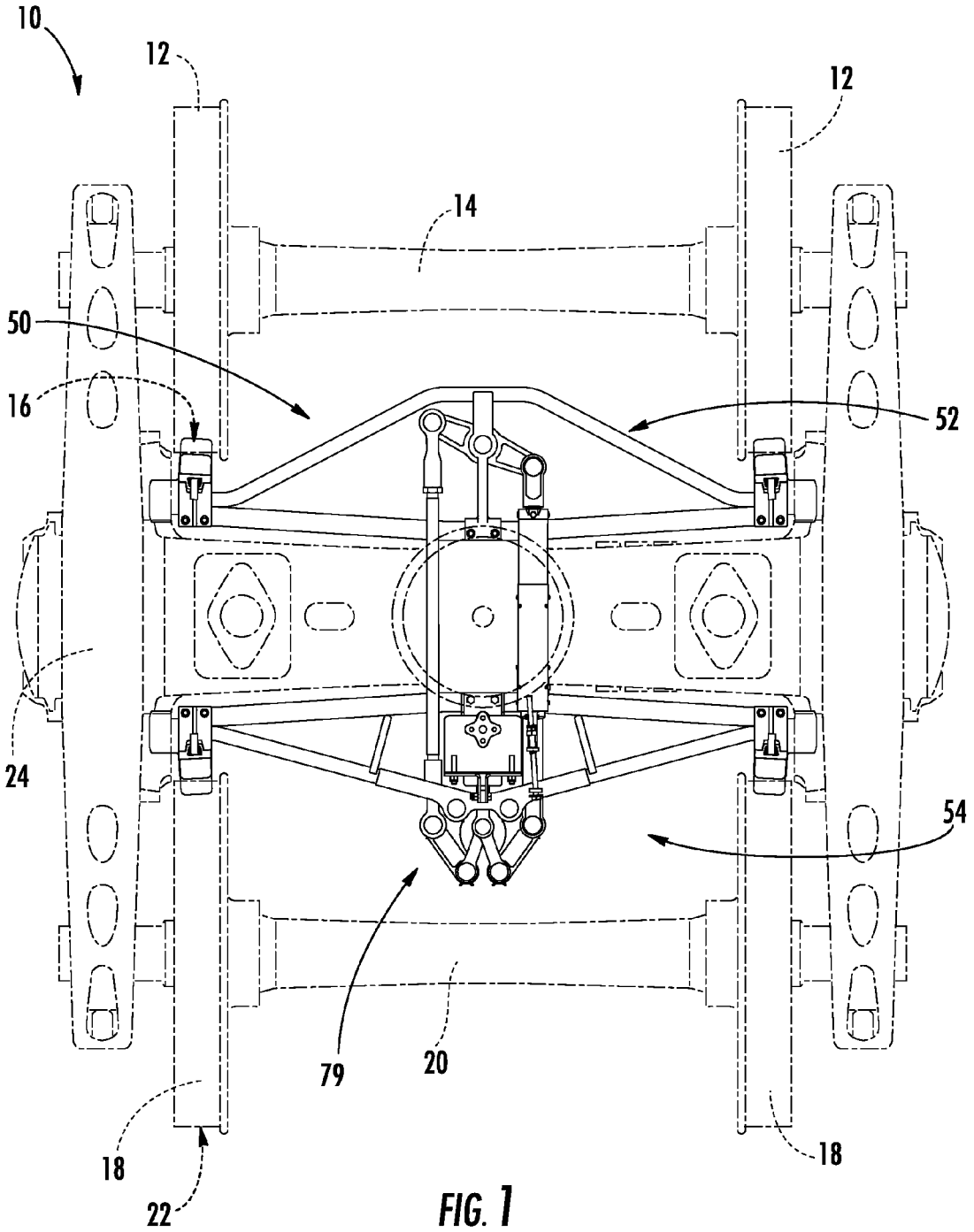
FIG. 1 is an overhead view of an exemplary railway car truck (shown in phantom) having a braking system in accordance with an exemplary embodiment of the present disclosure installed therein.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. Similarly, the terms "front" and "rear" may be used to describe certain components relative to one another, it being understood that the orientation of the components may be reversed depending on a traveling direction of the railway car. Moreover, the term "longitudinally" refers to the relative direction substantially parallel to the traveling direction of a railway car, and "radially" refers to the relative direction substantially perpendicular to the traveling direction of the railway car.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a braking system for a railway car capable of generating a wide range of divergent braking forces between a first and second brake assembly. The braking system generally includes a brake cylinder having a cylinder rod, the cylinder rod in mechanical communication with a lever transfer assembly including pair of opposing live levers. The cylinder rod is configured to articulate the live levers. The live levers are pivotally connected to a first brake assembly and connected to a rear brake assembly through respective connection rods. Actuating the live levers with the cylinder rod generates a divergent braking force between the first and second brake assemblies, transferred through the connection rods, for slowing and/or stopping the railway car. The amount of the divergent braking force generated may be adjusted based at least in part on a starting position of the lever transfer assembly, or more particularly, a starting position of the live levers.

Referring now to the Figs., FIG. 1 provides a braking system 50 in accordance with an exemplary embodiment of the present disclosure, installed in an exemplary railway car truck 10 (shown in phantom). The railway car truck depicted in FIG. 1 generally includes a first axle 14 and a second axle 20, connected and supported by a chassis 24. The first axle 14 includes a pair of first wheels 12 rotatably mounted thereto and similarly, the second axle 20 includes a pair of second wheels 18 rotatably mounted thereto. The chassis 24 may support a portion of a railway car (not shown) and allow the truck 10 and railway car, using the first and second wheels 12, 18, to roll along a corresponding infrastructure of railway car tracks (not shown).

As will be discussed in greater detail below, the railway car truck 10 further includes an exemplary braking system 50, including a first brake assembly 52 and a second brake assembly 54, spaced from one another along a longitudinal centerline, L (see FIGS. 3-5). In certain exemplary embodiments, the first brake assembly 52 may correspond to a front brake assembly and the second brake assembly 54 may correspond to a rear brake assembly. Similarly, in certain exemplary embodiments, the first and second axles 14, 20 of the truck 10 may correspond to front and rear axles, and the first and second wheels 12, 18 may correspond to front and rear wheels. The braking system 50 is configured to generate friction between an outer periphery 16, 18 of the first and second wheels 12, 18, respectively, to slow and/or stop the railway car truck 10.

Figure 2:
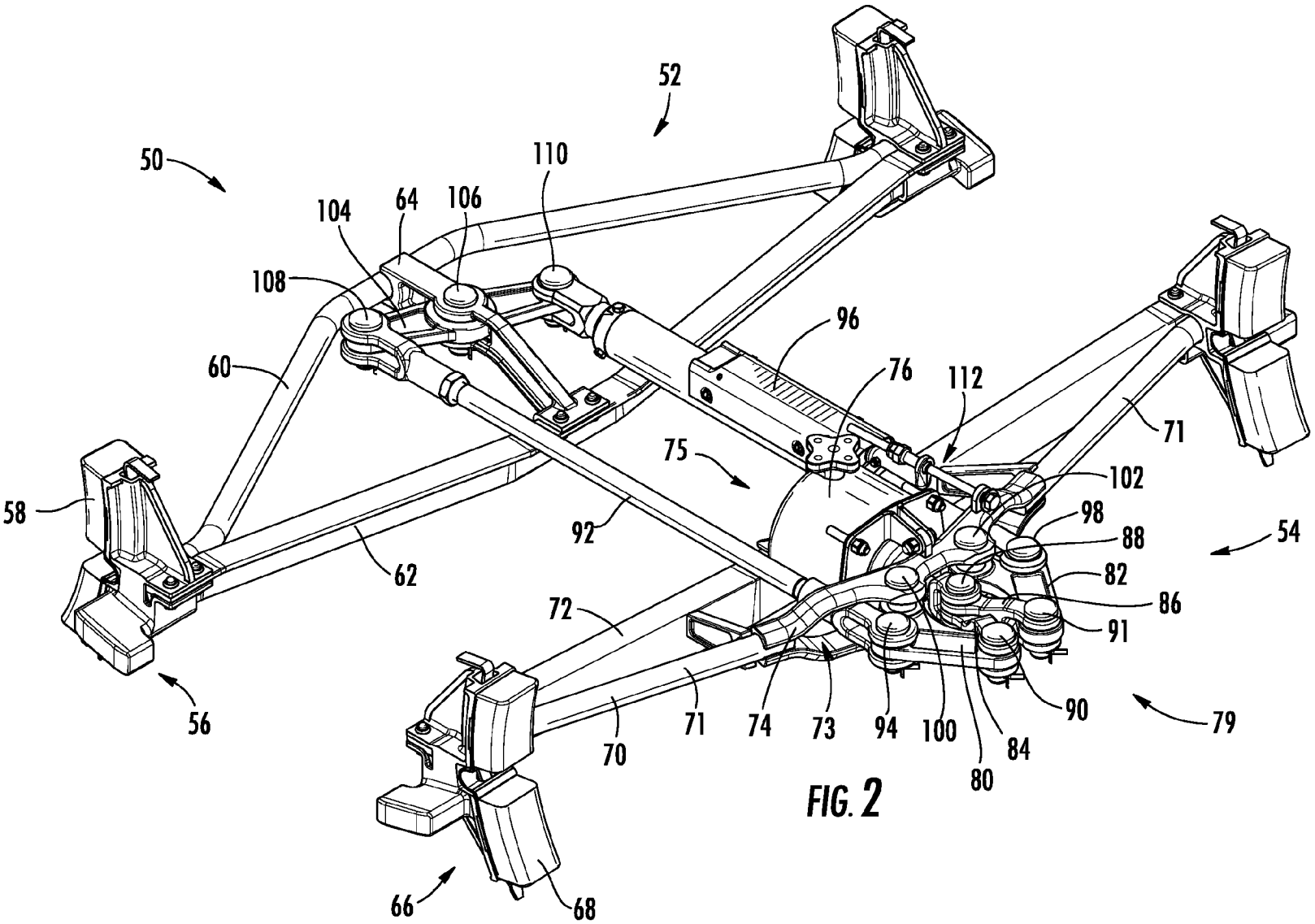
FIG. 2 is a perspective view of the exemplary braking system depicted in FIG. 1.
Figure 3:
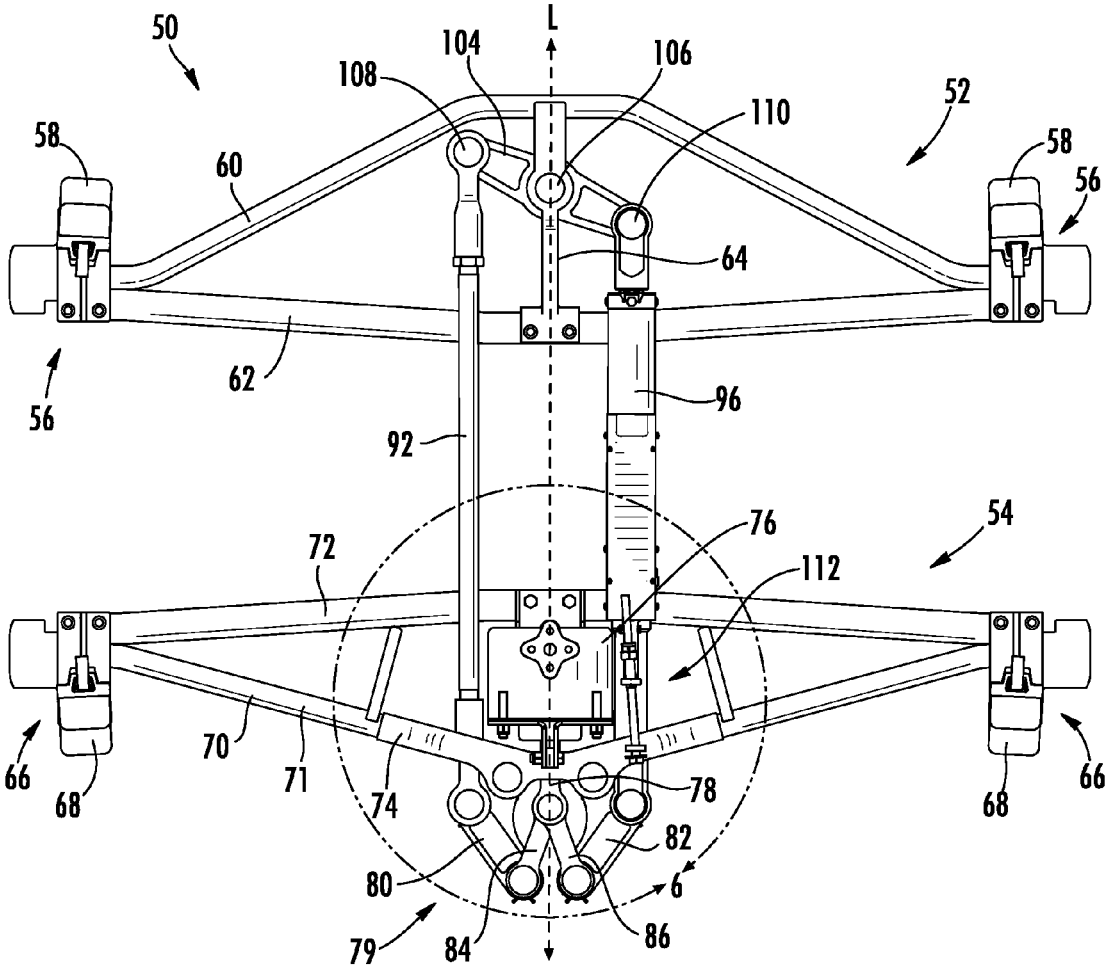
FIG. 3 is an overhead view of the exemplary braking system depicted in FIG. 1.
Figure 4:
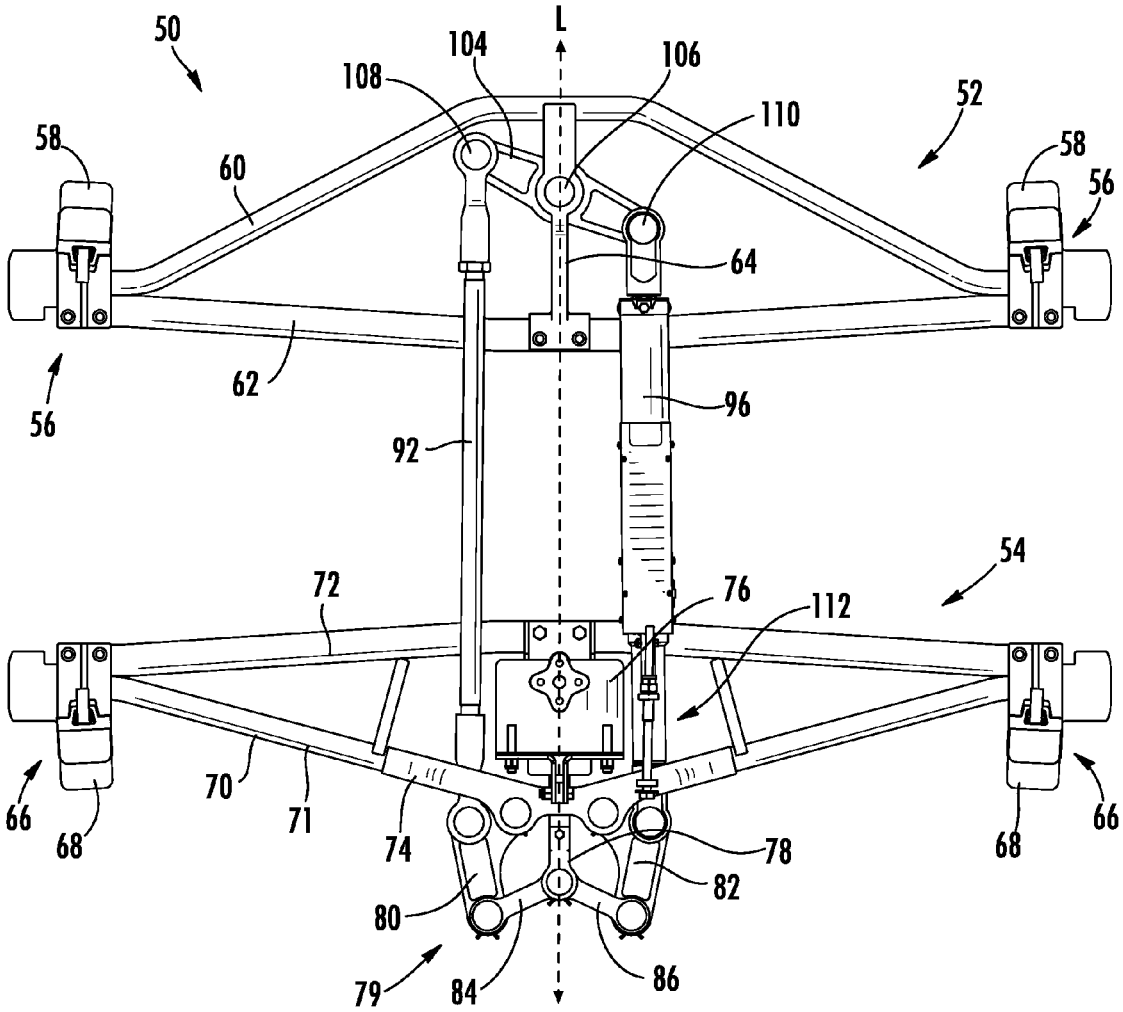
FIG. 4. is an overhead view of the exemplary braking system depicted in FIG. 1 with a cylinder rod extended as compared to the view of FIG. 1.

Referring now to FIGS. 2-4, the exemplary braking system 50 of FIG. 1 will be described in greater detail. FIGS. 2 and 3 provide a perspective view and an overhead view of the braking system 50 of FIG. 1 with a cylinder rod 78 in a retracted position as in FIG. 1, while FIG. 4 provides an overhead view of the braking system 50 with the cylinder rod 78 in an extended position relative to FIG. 1.

The first brake assembly 52 includes a pair of brake heads 56 disposed at radial ends of the first brake assembly 52. The brake heads 56 each include one or more brake pads 58 defining a thickness and configured to contact an outer periphery 16 of the first wheels 12 (see FIG. 1). Extending between the brake heads 56 are a tension bar 60 and a compression bar 62, braced with a strut 64. As will be discussed below, the strut 64 receives a divergent braking force through a connection point 106, which is transferred through the tension and compression bars 60, 62 to the brake heads 56 and brake pads 58. Each connection point described herein may include any suitable construction for rotatably connecting two or more members, such as a pinned connection, hinged connection, etc.

As with the first brake assembly 52, the second brake assembly 54 similarly includes a pair of brake heads 66 disposed at radial ends of the second brake assembly 54, each with one or more brake pads 68 defining a thickness and configured to contact an outer periphery 22 of the second wheels 18. The second brake assembly 54 also includes a compression bar 72 and a tension bar 70 extending between the brake heads 66. Notably, the tension bar 70 depicted in FIGS. 2-4 is comprised of a pair of side arms 71 rigidly connected by a bracket 74.

One having skill in the art will appreciate, however, that in other exemplary embodiments, the braking system 50 may have any other suitable configuration of first and second brake assemblies 52, 54. For example, in other exemplary embodiments, the brake heads 56, 66 may have any other suitable construction and may include any suitable number of brake pads 58, 68. In still other embodiments, the brake assemblies 52, 54 may not include both the tension and/or compression bars, and additionally, or alternatively, may include any other suitable configuration of struts 64, bracket 74, or other structural components.

Referring still to FIGS. 2-4, the braking system 50 slows and/or stops the railway car truck 10 (see FIG. 1) by applying a divergent braking force between the first and second brake assemblies 52, 54, or more particularly, through the brake assemblies 52, 54 to the respective brake heads 56, 66 and brake pads 58, 68. For the exemplary braking system 50 depicted in FIGS. 2-4, said force originates with a brake cylinder 75 attached to the second brake assembly 54. The brake cylinder 75 includes a body 76 and a cylinder rod 78 (see FIGS. 3 and 4) and may be any suitable cylinder assembly for generating a linear force, such as an air powered cylinder, hydraulic cylinder, or electric cylinder. Alternatively, any other device may be used for generating a linear force, such as an inflatable air bag. The exemplary cylinder rod 78 extends longitudinally along the longitudinal centerline L away from the body 76 to engage, or apply, the braking system 50. As shown, the cylinder rod 78 is in mechanical communication with, and configured to articulate, a lever transfer assembly 79 that is generally symmetric about the longitudinal centerline L. As will be discussed, the lever transfer assembly 79 may allow for adjustment, e.g., increasing or decreasing, of an amount of braking force generated by the brake cylinder 75 to be applied as a divergent braking force, and may apply and/or distribute said braking force evenly amongst the brake assemblies 52, 54 relative to the centerline L.

The lever assembly 79 generally includes a pair of opposing live levers, or more particularly, a first live lever 80 and a second live lever 82, disposed opposite the longitudinal centerline L from one another. As used herein, "live lever" refers to a lever that is configured to rotate during operation of the braking assembly 50. Each live lever 80, 82 is rotatably connected to the second brake assembly 54 and connected to the first brake assembly 52 through respective connection rods (discussed below). The first and second live levers 80, 82 are rotatably connected to the second brake assembly 54 at connection points 100 and 102, respectively. More particularly, as depicted in FIGS. 2-4, the first and second live levers 80, 82 are rotatably connected to the tension bar bracket 74, the bracket 74 further defining bracket openings 73 (see FIG. 2) to facilitate the rotation of the first and second live levers 80, 82 about connection points 100, 102. Moreover, the live levers 80, 82 depicted in FIGS. 2-4 are rotatably connected to the second brake assembly 54 at a fixed distance from the longitudinal centerline L. One having skill in the art will appreciate, however, that in other exemplary embodiments, the live levers 80, 82 may additionally, or alternatively, be attached to the second brake assembly 54 in any other suitable manner, and that in certain of said embodiments, the live levers 80, 82 may not be connected to the second brake assembly 54 at a fixed distance from the longitudinal centerline L. Additionally, in other exemplary embodiments, the first and second live levers 80, 82 may not be symmetric about the longitudinal centerline L.

The cylinder rod 78 is in mechanical communication with a first end of the first live lever 80 and a first end of the second live lever 82 for articulating each live lever 80, 82 and generating the divergent braking force for moving the first and second brake assemblies 52, 54 away from one another along the longitudinal centerline L. More particularly, for the exemplary embodiment depicted in FIGS. 2-4, the lever assembly 79 includes a pair of opposing offset members 84, 86 defining a first end and a second end, each offset member 84, 86 rotatably connected at the first end to the cylinder rod 78, through a connection point 88, and at the second end to a respective live lever 80, 82, through connection points 90 and 91, respectively. Accordingly, for the exemplary embodiment of FIGS. 2-4, the cylinder rod 78 articulates the first and second live levers 80, 82 by transferring a force through the respective offset members 84, 86 rotatably connected to the cylinder rod 78 at connection point 88.

It should be appreciated, however, that the embodiment of FIGS. 2-4 is provided by way of example only. In other exemplary embodiments, the braking system 50, or more particularly, the lever transfer assembly 79, may not include the offset members 84, 86 and additionally, or alternatively, cylinder rod 78 and live levers 80, 82 may have any other suitable shape or construction to allow the cylinder rod 78 to articulate live levers 84, 86. For example, in other exemplary embodiments, the cylinder rod 78 may be slidingly connected to live levers 80, 82, or alternatively another lever configuration may be provided.

As stated above, the lever assembly 79 is also connected to the first and second connection rod. For the exemplary embodiment depicted in FIGS. 2-4, the first connection rod corresponds to a push rod 92 rotatably connected to the first live lever 80 through a connection point 94, and the second connection rod corresponds to a slack adjuster 96 rotatably connected to the second live lever through a connection point 98. However, in other exemplary embodiments, the braking system 50 may include any other combination of connection rods.

As shown, the push rod 92 and slack adjuster 96 each extend to the first brake assembly 52 and rotatably attach to a dead lever 104 via connection points 108 and 110, respectively. Due at least in part to its symmetrical construction, the lever assembly 79 may transfer a force from the cylinder rod 78 evenly to the push rod 92 and slack adjuster 96. Therefore, an angular position of the dead lever 104 relative to the longitudinal centerline L may remain substantially constant when the cylinder rod 78 articulates the live levers 80, 82 of the lever assembly 79. This may allow for the first and second brake assemblies 52, 54 to be evenly and symmetrically moved away from one another relative to, and along, the longitudinal centerline L, such that the brake pads 58 of the first brake assembly 52 contact the first wheels 12 concurrently and the brake pads 68 of the second brake assembly 54 contact the second wheels 18 concurrently (see FIG. 1). The brake pads 58, 68 may therefore wear more evenly and consistently with such a configuration.

Figure 5:
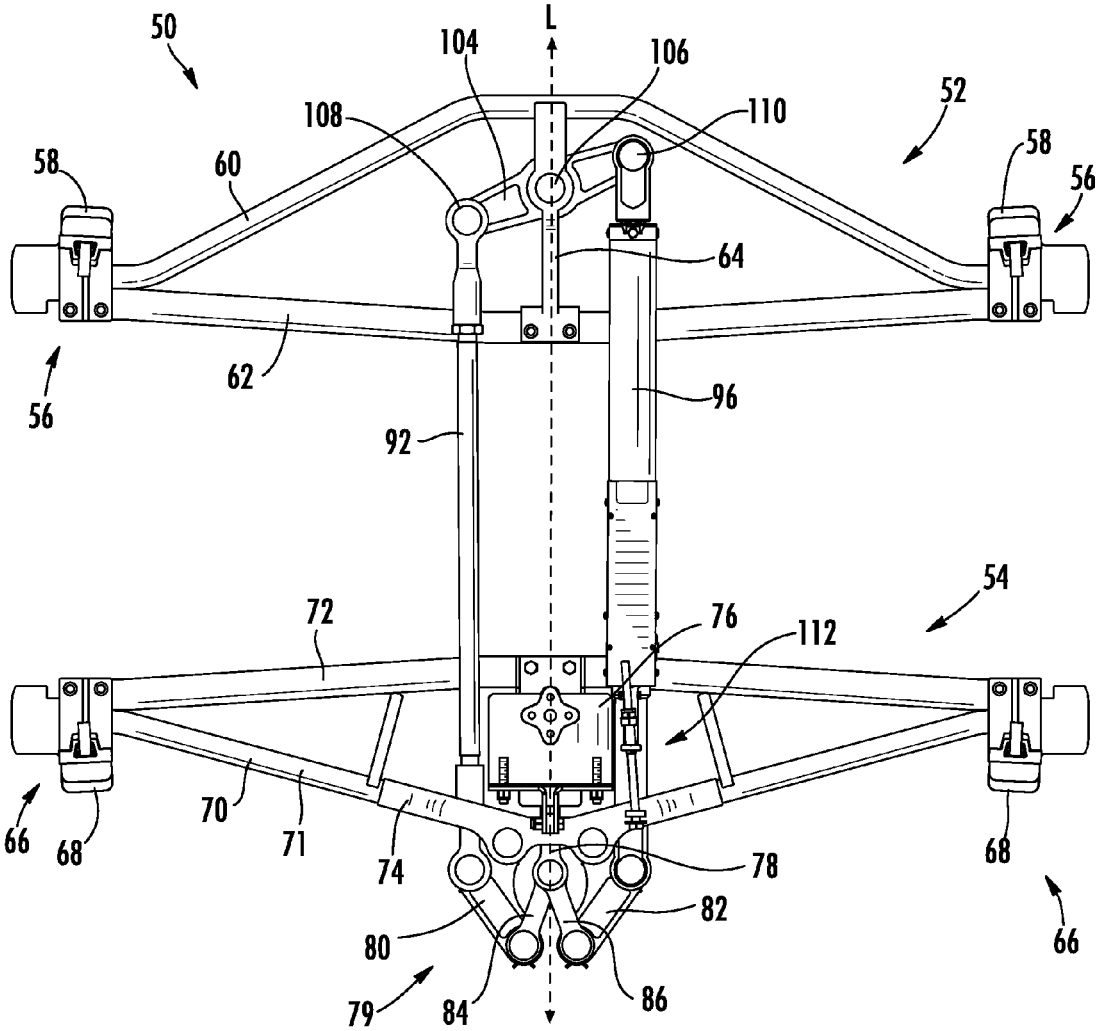
FIG. 5 is an overhead view of the exemplary braking system depicted in FIG. 1 with a slack adjuster extended and brake pads worn as compared to the view of FIG. 1.
Figure 6:
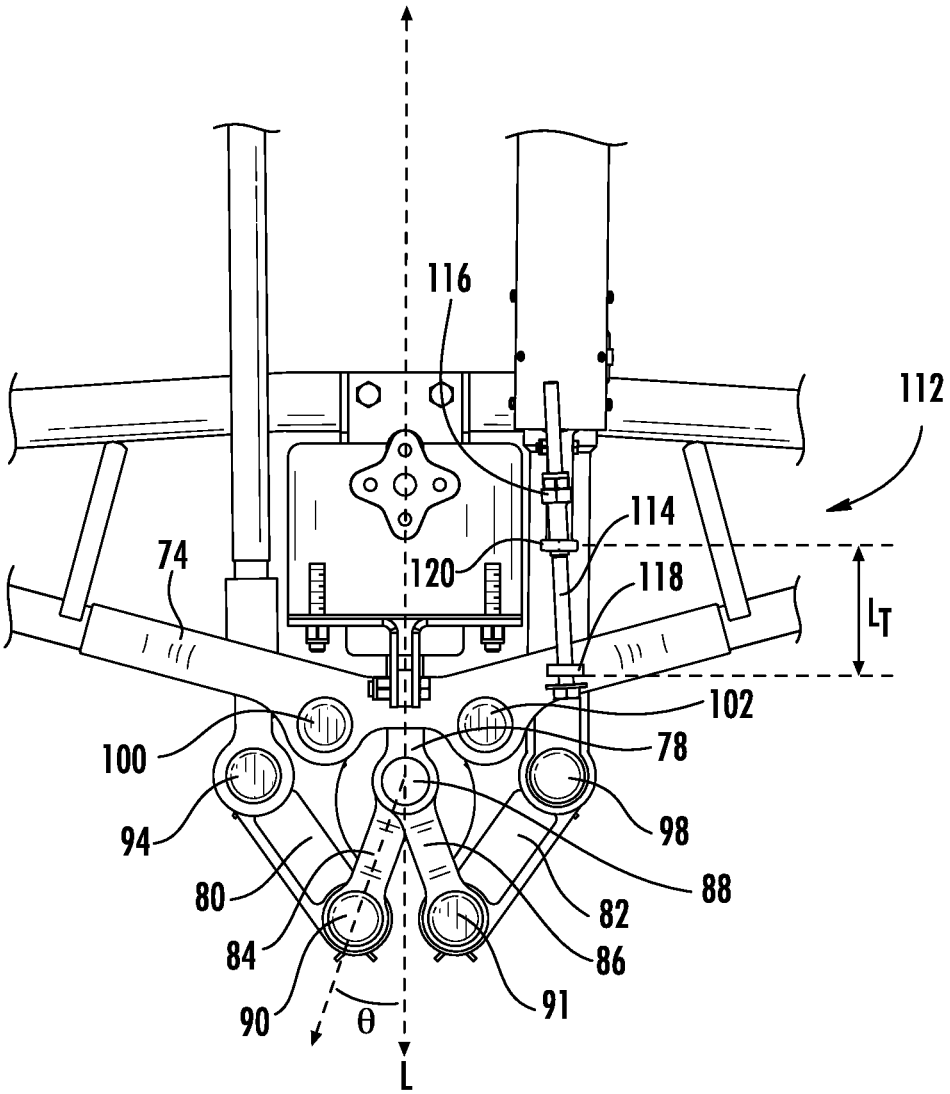
FIG. 6 is a close-up overhead view of a portion of the exemplary braking system, taken from Section 6 in FIG. 3.

Referring now to FIGS. 5 and 6, an overhead view of the braking system 50 and a close-up overhead view of the braking system 50, taken from Section 6 of FIG. 3, are provided. More particularly, the braking system 50 is depicted in FIG. 5 after the brake pads 58, 68 have worn such that their respective thicknesses have decreased.

As is known, over the life of the brake pads 58, 68, their thickness decreases. However, the braking system 50 is configured to extend longitudinally to accommodate said decrease such that a stroke of the cylinder rod 78 of the brake cylinder 75 remains constant throughout the life of the pads 58, 68. Referring back to FIGS. 3 and 4, a comparison may illustrate the brake stroke of the cylinder rod 78. Essentially, the brake stroke may be defined as a distance the cylinder rod 78 must travel between a released position (FIG. 3) and an applied position (FIG. 4)—i.e., the distance the cylinder rod 78 must travel longitudinally relative to the body 76 from a starting position for the pads 58, 68 to contact the respective wheels 12, 18.

The extension of the braking system 50 is provided by the slack adjuster 96, the dead lever 104, and a trigger 112. As the pads 58, 68 wear down, a length of the slack adjuster 96 between connection points 98 and 110 incrementally and gradually increases, prompted by the trigger 112. Since a length of the push rod 92 between connection points 94 and 108 remains constant, the dead lever 104 is rotated counterclockwise about connection point 106 as the slack adjuster 96 incrementally extends. This effect is depicted in FIG. 5, wherein an effective length of the braking system 50 along the longitudinal centerline L has been increased to accommodate worn brake pads 58, 68. The increase in effective length is owed to a lengthening of the slack adjuster 96. Therefore, the starting position of the cylinder rod 78 is not affected, allowing for a consistent stroke of the cylinder rod 78 throughout the life of the brake pads 58, 68 (and consistent divergent braking force throughout the life of the brake pads 58, 68).

With specific reference now to the close-up view of FIG. 6, the cylinder rod 78 and lever system 79 are shown in greater detail. As shown, the connection members 84, 86 define an angle θ relative to the cylinder rod 78 and longitudinal centerline L. As one having skill in the art will appreciate, the amount of divergent stopping force generated between the first and second brake assemblies 52, 54 increases as the angle θ of the connection members 84, 86 approaches 90 degrees. For example, assuming a constant amount of force in the longitudinal direction from the cylinder rod 78, the divergent stopping force generated between the first and second brake assemblies 52, 54 when the angle θ is about 15 degrees will be less than when the angle θ is about 45 degrees. Accordingly, the amount of divergent stopping force between the first and second brake assemblies 52, 54—relative to an amount of force applied by cylinder rod 78—may be adjusted by adjusting the starting position of the cylinder rod 78, without the need to vary the size and/or power of the brake cylinder 75.

The starting position of the cylinder rod 78 and the starting angle θ of the connection members 84, 86 may be adjusted when the braking system 50 is installed in the railway car truck 10 (see FIG. 1), or at another appropriate time. Such functionality may be provided in part through the trigger 112. The trigger 112 may sense an overextension of the braking system 50 and cylinder rod 78, and adjust (e.g., extend the length of) the slack adjuster 96 in response. The exemplary trigger 112 of FIG. 6 is generally comprised of a bolt 114 and a nut 116. As shown, the trigger 112 defines an effective longitudinal length $L_T$ and is slidably attached to the second brake assembly 54 through a eyelet 118 on the tension bar bracket 74 and to one of the connection rods. For the embodiment of FIG. 6, the trigger 112 is slidably attached to the slack adjuster 96 through an additional eyelet 120, but one having skill in the art will appreciate that the trigger 112 may alternatively be slidably attached in any other suitable manner, and at any other suitable location, such as to the push rod 92. The effective length $L_T$ of the trigger is adjustable by tightening or loosening the nut 116 on the bolt 114. As depicted, the effective length $L_T$ corresponds to the starting position of the cylinder rod 78, and accordingly adjusting the effective length $L_T$ of the trigger 112 adjusts an amount of force applied through the live levers 80, 82 to the connection rods from the cylinder rod 78.

Figure 7:
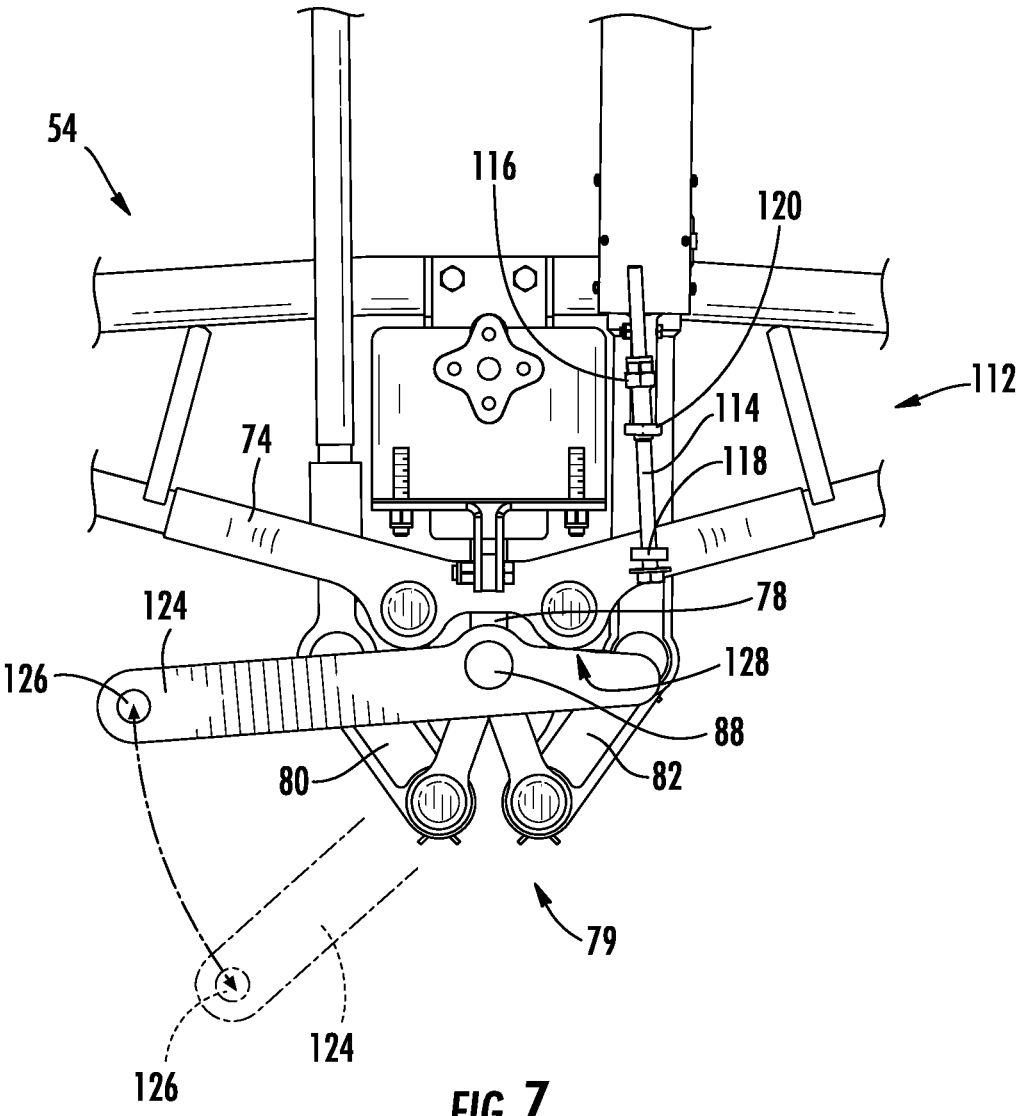
FIG. 7 is a close-up overhead view of a portion of an exemplary braking system in accordance with another exemplary embodiment of the present disclosure.

Another exemplary embodiment of the present disclosure is provided in the close-up overhead view of FIG. 7. In the exemplary embodiment shown, the braking system 50 further comprises a hand brake arm 124 rotatably connected to the cylinder rod 78 at attachment point 88. Additionally, the arm 124 abuts the second brake assembly 54 such that the second brake assembly 54 is a fulcrum when the hand brake arm 124 is rotated about the attachment point 88 and the cylinder rod 78. More particularly, the arm 124 abuts the tension bar bracket 74 of the second brake assembly 54 and defines a fulcrum surface 128 and a hand brake attachment 126. The hand brake attachment 126 of the arm 124 may be connected to a manual hand brake located in, for example, the railway car (not shown). The arm 124 may be rotated about the connection point 88 in a counter clockwise direction (when viewed from the overhead view of FIG. 7) such that the surface 128 abuts the bracket 74 and forces the cylinder rod 78 away from the body 76 of the brake cylinder 75, generating a braking force between the first and second brake assemblies 52, 54. This rotation is depicted in phantom in the view of FIG. 7.

It should be appreciated, however, that in other exemplary embodiments, the braking system 50 may include any other suitable hand brake arm 124, attached in any suitable location. For example, the hand brake arm 124 may be attached rigidly or rotatably to one or both of the live levers 80, 82 and additionally, or alternatively may be rigidly or rotatably attached to one or both of the offset members 84, 86. Furthermore, in still other exemplary embodiments, the hand brake arm 124 may be attached to the cylinder rod 78 and configured to abut the tension bar bracket 74.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A braking system for a railway car, the braking system defining a longitudinal centerline and comprising:
   a. a first brake assembly and a second brake assembly spaced from one another along the longitudinal centerline;
   b. a pair of live levers each defining a first end and disposed opposite the longitudinal centerline from one another, the live levers rotatably connected to the second brake assembly and connected to the first brake assembly through respective connection rods, wherein each of the live levers are rotatably connected to the second brake assembly at a fixed distance from one another;
   c. a brake cylinder including a cylinder rod, the cylinder rod in mechanical communication with the first end of each live lever for articulating each live lever and moving the first and second brake assemblies away from one another along the longitudinal centerline; and
   d. a pair of opposing single-piece offset members defining a respective first end and a respective second end, each offset member rotatably connected at the first end to the brake cylinder and at the second end to a respective live lever;
   e. wherein the cylinder rod extends along the longitudinal centerline, wherein the live levers each articulate about a connection point on the second brake assembly when the cylinder rod is extended, wherein the live levers press the second brake assembly in a first direction along the longitudinal centerline when the cylinder rod is extended, and wherein the live levers press the first brake assembly in a second and opposite direction along the longitudinal centerline when the cylinder rod is extended.

2. The braking system of claim 1, wherein one connection rod is a push rod and the other connection rod is a slack adjuster, the slack adjuster defining a length and configured to gradually extend in length during operation of the braking system.

3. The braking system of claim 2, wherein the cylinder rod extends along the longitudinal centerline from a body of the brake cylinder when articulating the live levers.

4. The braking system of claim 1, wherein the connection rods are connected to the first brake assembly through a dead lever and wherein an angular position of the dead lever relative to the longitudinal centerline remains substantially constant when the brake cylinder articulates the live levers.

5. The braking system of claim 1, further comprising a trigger defining a longitudinal length and slidably attached to the second brake assembly and one of the connection rods, wherein the length of the trigger is adjustable and corresponds to a starting position of the cylinder rod.

6. The braking system of claim 5, wherein adjusting the length of the trigger adjusts an amount of force applied through the live levers to the connection rods from the brake cylinder.

7. The braking system of claim 1, wherein the brake cylinder is attached to the second brake assembly.

8. The braking system of claim 1, further comprising a hand brake arm rotatably connected to the cylinder rod and abutting the second brake assembly such that the second brake assembly is a fulcrum when the hand brake arm is rotated about the cylinder rod.

9. The braking system of claim 1, wherein each of the live levers are rotatably connected to the second brake assembly at a second end of the respective live levers, wherein each of the live levers are connected to the respective connection rods at a respective intermediate connection point, and wherein each respective intermediate connection point of each live lever is positioned closer to the second end of the respective live lever than the first end of the respective live lever.

10. The braking system of claim 1, wherein the pair of opposing offset members are each rigid offset members extending linearly directly between the cylinder rod and the respective live lever.

11. A braking system for a railway car, the braking system defining a longitudinal centerline and comprising:

a. a first brake assembly and a second brake assembly spaced from one another along the longitudinal centerline;

b. a first live lever and a second live lever, the first and second live levers connected to the first brake assembly using respective connection rods and rotatably connected to the second brake assembly at respective connection points, wherein each of the live levers are rotatably connected to the second brake assembly at a fixed distance from one another; and c. a brake cylinder comprising a cylinder rod in mechanical communication with the first and second live levers for articulating the first and second live levers about their respective connection points and moving the first brake assembly away from the second brake assembly along the longitudinal centerline using the respective connection rods; and d. a pair of opposing single-piece offset members defining a respective first end and a respective second end, each offset member rotatable connected at the first end to the brake cylinder and at the second end to a respective live lever;

e. wherein the cylinder rod extends along the longitudinal centerline, wherein the first and second live levers press the second brake assembly in a first direction along the longitudinal centerline when the cylinder rod is extended, and wherein the first and second live levers press the first brake assembly in a second and opposite direction along the longitudinal centerline when the cylinder rod is extended.

12. The braking system of claim 11, further comprising a trigger defining a length and slidably attached to the second brake assembly and one of the connection rods, wherein the length of the trigger is adjustable and corresponds to a starting position of the brake cylinder.

13. The braking system of claim 12, wherein adjusting the length of the trigger adjusts an amount of force applied through the live levers to the connection rods from the brake cylinder.

14. A braking system for a railway car, the braking system defining a longitudinal centerline and comprising:

a. a first brake assembly and a second brake assembly spaced from one another along the longitudinal centerline;

b. a lever transfer assembly rotatably connected to the second brake assembly and connected to the first brake assembly through a pair of connection rods, the lever transfer assembly substantially symmetric about the longitudinal centerline, wherein the lever transfer assembly comprises a pair of opposing live levers rotatably connected to the second brake assembly, and wherein each of pair of opposing live levers are rotatably connected to the second brake assembly at a fixed distance from one another; and c. a brake cylinder comprising a cylinder rod extendable along the longitudinal centerline and in mechanical communication with the lever transfer assembly, wherein the live levers of the lever transfer assembly each articulate about a connection point on the second brake assembly when the cylinder rod is extended, and wherein the live levers press the first brake assembly away from the second brake assembly along the longitudinal centerline when the cylinder rod is extended; and d. a pair of opposing single-piece offset members defining a respective first end and a respective second end, each offset member rotatably connected at the first end to the brake cylinder and at the second end to a respective live lever.

15. The braking system of claim 14, wherein the brake cylinder further comprises a body, the cylinder rod extending from the body along the longitudinal centerline.

16. The braking system of claim 14, wherein the lever transfer assembly is rotatably connected to the second brake assembly at two points located at a fixed distance from the longitudinal centerline.

* * * * *